United States Patent [19]

Williams

[11] Patent Number: 4,658,878

[45] Date of Patent: Apr. 21, 1987

[54] ACOUSTIC TYPE FOLDING DOOR WITH SEPARATE COVER SECTIONS

[75] Inventor: Charles E. Williams, Delavan, Wis.

[73] Assignee: Hough Manufacturing Corporation, Janesville, Wis.

[21] Appl. No.: 809,246

[22] Filed: Dec. 16, 1985

[51] Int. Cl.[4] ..... E06B 9/262

[52] U.S. Cl. ..... 160/84 V

[58] Field of Search ..... 160/84 R, 84 H, 84 V, 160/348

[56] References Cited

U.S. PATENT DOCUMENTS

| | | | |
|---|---|---|---|
| 2,782,895 | 2/1957 | Johnson | 160/84 |
| 2,801,687 | 8/1957 | Ensign et al. | 160/84 |
| 2,860,697 | 11/1958 | Ensign et al. | 160/84 |
| 2,861,660 | 11/1958 | Ensign | 189/46 |
| 2,903,055 | 9/1959 | Merrill | 160/40 |
| 3,056,193 | 10/1962 | Johnson et al. | 29/407 |
| 3,082,817 | 3/1963 | Merrill | 160/40 |
| 3,223,147 | 12/1965 | Holloway | 160/84 |
| 3,450,185 | 6/1969 | Holloway | 160/199 |
| 3,708,009 | 1/1973 | Viol et al. | 160/84 V |
| 3,850,223 | 11/1974 | Tompkins | 160/84 R |

FOREIGN PATENT DOCUMENTS

| | | | |
|---|---|---|---|
| 1233680 | 5/1960 | France | 160/84 R |
| 1544159 | 10/1979 | United Kingdom | 160/84 R |

*Primary Examiner*—Ramon O. Ramirez
*Assistant Examiner*—Cherney S. Lieberman
*Attorney, Agent, or Firm*—Mann, McWilliams, Zummer & Sweeney

[57] ABSTRACT

An accordian type folding door of the type disclosed in Holloway U.S. Pat. No. 3,233,147 in which each cover of the door is in the form of consecutive cover sections, connected to the door lazytongs in side by side relation, each of which cover sections defines a fold or pleat of the door and includes a pair of relatively wide slats of substantially equal width disposed on either side of a relative narrow slat, with such slats being pivoted together by inner and outer flexible sheets that are respectively adhered to the opposite faces of the respective slats; for each cover section of the door covers, the flexible sheets extend beyond the relatively wide slats thereof to define sheet end portions, with such sheet end portions of adjacent cover sections being clamped together by a spline that extends the height of the cover that the cover sections define. Each pleat or fold of the respective door covers thus extends between separate of such splines with each spline being vertically disposed and pivotally connected to the door upper and lower lazytongs for door closing and opening movement of the door covers with the door lazytongs.

14 Claims, 8 Drawing Figures

ACOUSTIC TYPE FOLDING DOOR WITH SEPARATE COVER SECTIONS

This invention relates to accordian type folding doors, and in particular, to such doors that are of the acoustic type that when, in their closed or wall forming positions, are to serve as sound insulation or sound retarding barriers.

Accordian folding doors and partitions have found a wide market as a means for separating large rooms, such as classrooms and rooms in restaurants or church facilities, or the like, into two or more smaller rooms. In such use, the effectiveness of accordian folding doors and partitions as a sound barrier has become increasingly important. Attainment of a high degree of efficiency of such doors insofar as sound insulation may be concerned has, however, been extremely difficult to obtain because of the fact that such doors and partitions, when they are in their open or stacked relation, must occupy a relatively small portion of the opening that is to be closed by such doors or partitions when in their extended or wall forming relations. This relationship is usually termed as the "stacking ratio"; thus, a door that may be stacked in its door open relation to a dimension equal to 1/5th of its extended or door forming relation is said to have a stacking ratio of one to five. A stacking ratio of one to five is generally considered to be satisfactory, but it has been found that in efforts to increase the sound reduction or sound barrier capabilities of such folding doors or partitions, there has in most instances been a marked increase in the stacking ratio, which necessarily limits the utility of such doors.

The acoustic performance of folding doors and partitions of the type indicated is based on standardized test measurements of the sound transmission loss at different frequencies between 125 and 4,000 cycles per second, with the results being expressed as a rating in decibels that constitutes the average attenuation with the several frequencies measured. This rating in decibels corresponds with the widely recognized standard for measuring sound transmission loss, ASTM E 90-61T pursuant to which the rating is designated as the "Sound Transmission Class", or "STC" of such door or partition.

In the arrangement of Holloway U.S. Pat. No. 3,223,147, granted Dec. 14, 1965, an acoustic type folding door or partition is provided that is of the general type disclosed in Johnson et al. U.S. Pat. No. 3,056,193, granted Oct. 2, 1962, with the folding door partition involved comprising a central frame having a pair of vertical edge posts at opposite ends of same, interconnected by upper and lower lazytongs that form the extensible and retractable inner frame for the door or partition involved. One of the edge posts is anchored to one jamb of the opening to be closed by the door or partition, while the other end post is at the movable end of the folding door or partition, and is suspended movably from an overhead track that extends across a room space opening to be closed by the door or partition. Where the door or partition is of extended length, the upper lazytong is similarly supported from the overhead track. On opposite sides of the door or partition extensible and contractable frame, foldable sound barrier covers are provided, in which each of the covers comprises a plurality of alternately wide slats and narrow slats that are pivotally interconnected by inner and outer cover sheets, with alternate narrow slats being pivotally connected to the upper and lower lazytongs for removably connecting the respective covers to the door frame.

Further in accordance with said Holloway patent, the wide slats of each cover comprise multi-ply structures that are formed to include a thin plate of mild rolled steel and a thin panel of chipboard or the like adhered to one face of same, with the vertical edges of the steel strip being rolled into return bends or flanges which clamp the chipboard panel or the like at its edges and serve also to impart stiffness to the steel plate. A second chipboard panel is adhered to the plate flanges and first mentioned chipboard panel. The alternate narrow slats formed by a pair of adhered together chipboard or cardboard strips of coextensive lengths.

The successive wide slats and alternate narrow slats referred to are connected together in a pivotal relationship by the application of a continuous decorative outer cover sheet, formed of vinyl plastic or the like, and a coextensive inner cover sheet that may be made of a suitable grade of kraft paper or the like. In the arrangement of the indicated Holloway patent, the inner and outer cover sheets are adhered together along and intermediate the respective slats to form flexible hinges in the cover involved, and the outer cover is fitted over the upper and lower ends of the slats and adhered to the back cover to mount the slats within the cover.

On the inner side of the cover vertically extending panels made up of a resilient fibrous insulating material, such as matted glass fibers, are glued to the inner cover sheet in coextensive relation to the wide slats, with the fibrous insulating material forming pads having a density of one-half pound per cubic foot.

As disclosed in said Holloway patent, tests of the acoustic door or partition there illustrated shows that the structural features of the door make possible attainment of STC ratings that were previously unattainable in folding doors of that type having satisfactory weight and folding or stacking characteristics. For instance, it was determined that the indicated steel ply included in the relatively wide slats increased the STC rating of the basic door or partition involved from 5 to 8 points.

It is further pointed out in the indicated Holloway patent that it is highly desirable where possible to minimize the weight of doors of this general type; while the application of the steel sheets to the cover relatively wide slats disclosed in this patent added additional weight to the doors, with a desirable STC increase in rating justifying this addition, the fibrous pads applied to the relatively wide slats enabled substantial additional acoustic improvement to be attained with the addition of relatively little weight, it being pointed out that such pads in one-half inch thickness contributed from 7 to 9 STC points to the door rating, while adding but 0.4 pound per square foot to the weight of the door.

As further brought out in said Holloway patent that where the relatively wide slats included both the indicated stiffened steel plates and the individual sound insulating pads in the manner therein disclosed, the resulting the resulting acoustic type folding doors have an extremely favorable stacking ratio of less than one to six, and tested out at an STC rating far above that obtained with prior door arrangements of this general type.

The present invention is directed to improvements in the door covers disclosed in said Holloway patent to arrange such covers in the form of separate cover sections that are separately connected together in side by side relation to form the respective door covers, and that are connected to the door or partition lazytongs in such a manner that the individual cover sections can be discarded and replaced, as needed, to the exclusion of the other cover sections. The lateral ends of the individual cover sections are secured to stiffening vertical splines that extend the height of the cover and are separately carried by each lazytong for providing a true parallel relationship of the cover folds or pleats in moving between the extended and retracted relations of the door, and the folding door or partition provided can accommodate additional mass applied to the door or partition covers for still further improved STC ratings of the door or partition.

Principal objects of the invention are to arrange the folding door or partition covers to be defined by separate cover sections that may be replaced as needed, separate and apart from the other cover sections of the door or partition structure involved, and that are arranged and mounted on the door for improved stacking ratio while accommodating additional mass application to the door covers for improved STC rating capability.

Another principal object of the invention is to provide a cover arrangement for accordian type folding doors and partitions to which the covers are free on the external sides of same of fasteners or the like that have heretofore been necessary to secure the cover to the door frame lazytongs.

Yet another principal object of the present invention is to provide a cover mounting arrangement for accordian type folding doors and partitions in which the individual covers at their connecting pivots to the door or partition lazytongs are rigified for the height of the cover.

Still another principal object of the invention is to provide a folding doors or partition that is characterized by the lack of any tendency to "spring back" when moved from its contracted relation.

Yet further objects of the invention are to provide an acoustical type folding door or partition that is economical of manufacture, that is convenient to install and use, and that has long useful life characteristics.

In accordance with the invention, an accordian type folding door or partition is provided of the general type disclosed in said Holloway patent in which the covers on either side of the door each comprise a plurality of replaceable vertical cover sections separately connected to the door or partition lazytongs in side by side relation, with each of the cover sections comprising a pair of relatively wide slats of substantially equal widths of the same general arrangement that as those of said Holloway patent, disposed on either side of a relatively narrow slat of the general type disclosed in said Holloway patent, with the relatively wide and relatively narrow slats of each cover section being pivoted together by inner and outer flexible sheets that again are of the general type disclosed in said Holloway patent, with the indicated cover sections each forming a separate fold or pleat of the cover involved.

With regard to each cover section the narrow slat of same is interposed between the relatively wide slats whereby the relatively wide slats of each cover section or pleat define a first vertical side edge that is disposed adjacent the narrow slat of same, and a second vertical side edge that is opposed to the wide slat first side edge. For each cover section, the inner and outer sheets of same terminate in laterally extending vertical edge portions which extend beyond the indicated second vertical side edges of the relatively wide slats to form first and second sheet end portions at like side edges of each of the cover sections.

The improved cover of the present invention includes a spline arrangement for the cover sections, involving a spline that extends the height of the cover, and is of generally U shaped section to receive the second and first end portions of adjacent of the respective cover sections, and is arranged to provide for clamping of same in place along the respective splines. Each spline is also provided with vertically spaced fittings for respectively anchoring, in a pivotal manner, the respective splines to the upper and lower lazytongs of the door or partition frame. The cover sections that form the cover end at the stationary and movable ends of the doors are respectively suitably secured to the respective end posts in sealed relation thereto.

Further in accordance with the invention the respective cover sections each include a pair of pads of the indicated low density resiliently compressible fibrous sound insulating material described in said Holloway patent, with each such pads of each such cover section being mounted internally thereof in full surfaced flush contacting relation against the inner cover sheet of such cover section at a location overlying and extending longitudinally of one of the wide slats thereof.

The arrangement is such that the cover section pads and wide slats are proportioned so that in the folded stacked relation thereof, the pads of each cover section engage each other free of any substantial compression and yet the folding door partition provides a favorable stacking ratio, with the covers of the door or partition arrangement being further arranged to accommodate the addition thereto of additional mass for improved STC ratings. Further, the cover sections are individually replaceable.

Other objects, uses, and advantages will be obvious or become apparent from a consideration of the following detailed description and the application drawings.

IN THE DRAWINGS

Figure 3:
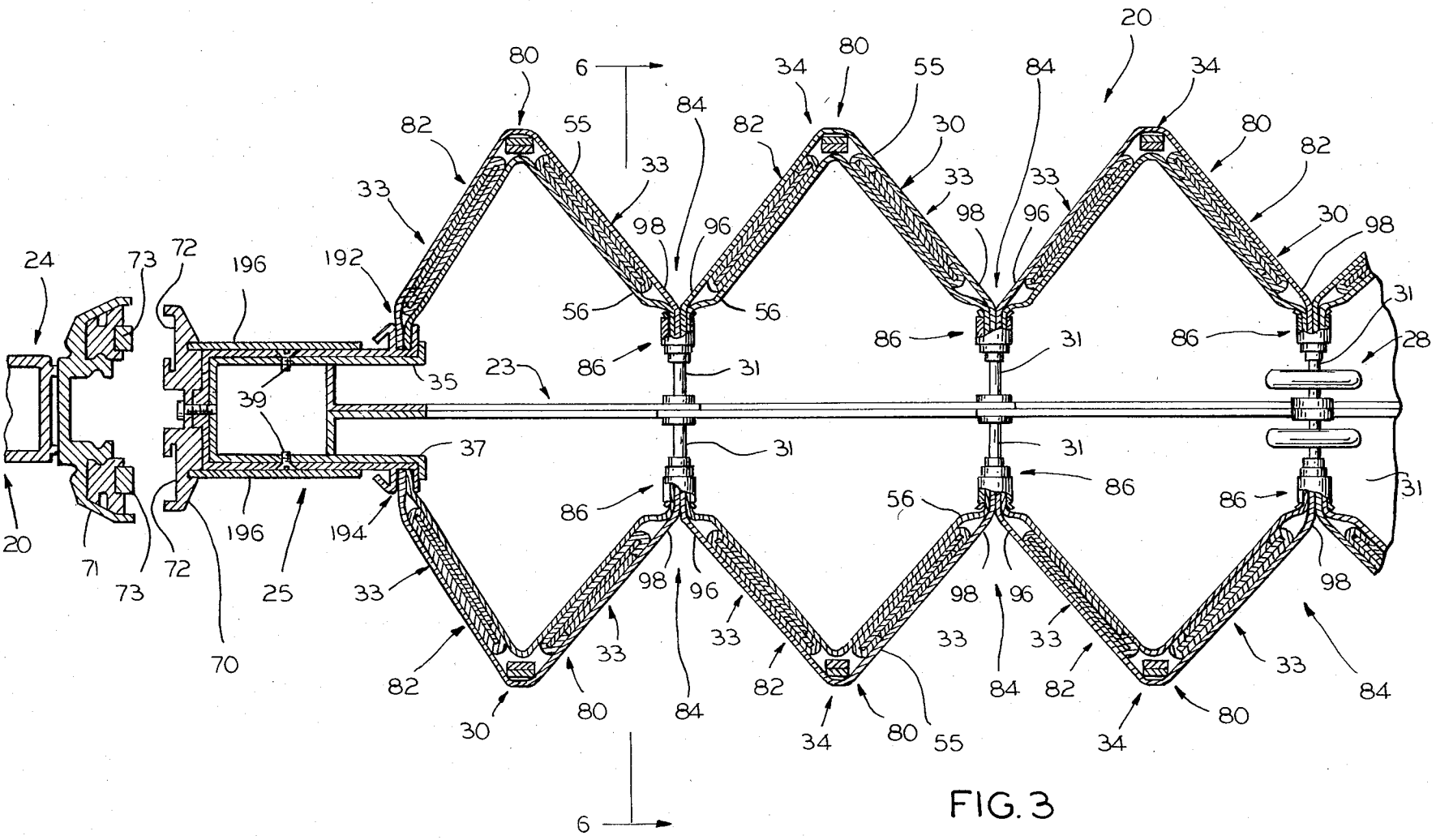
FIG. 3 is an enlarged horizontal sectional across-sectional view through the leading end of a folding door or partition arranged in accordance with the present invention.
Figure 6:
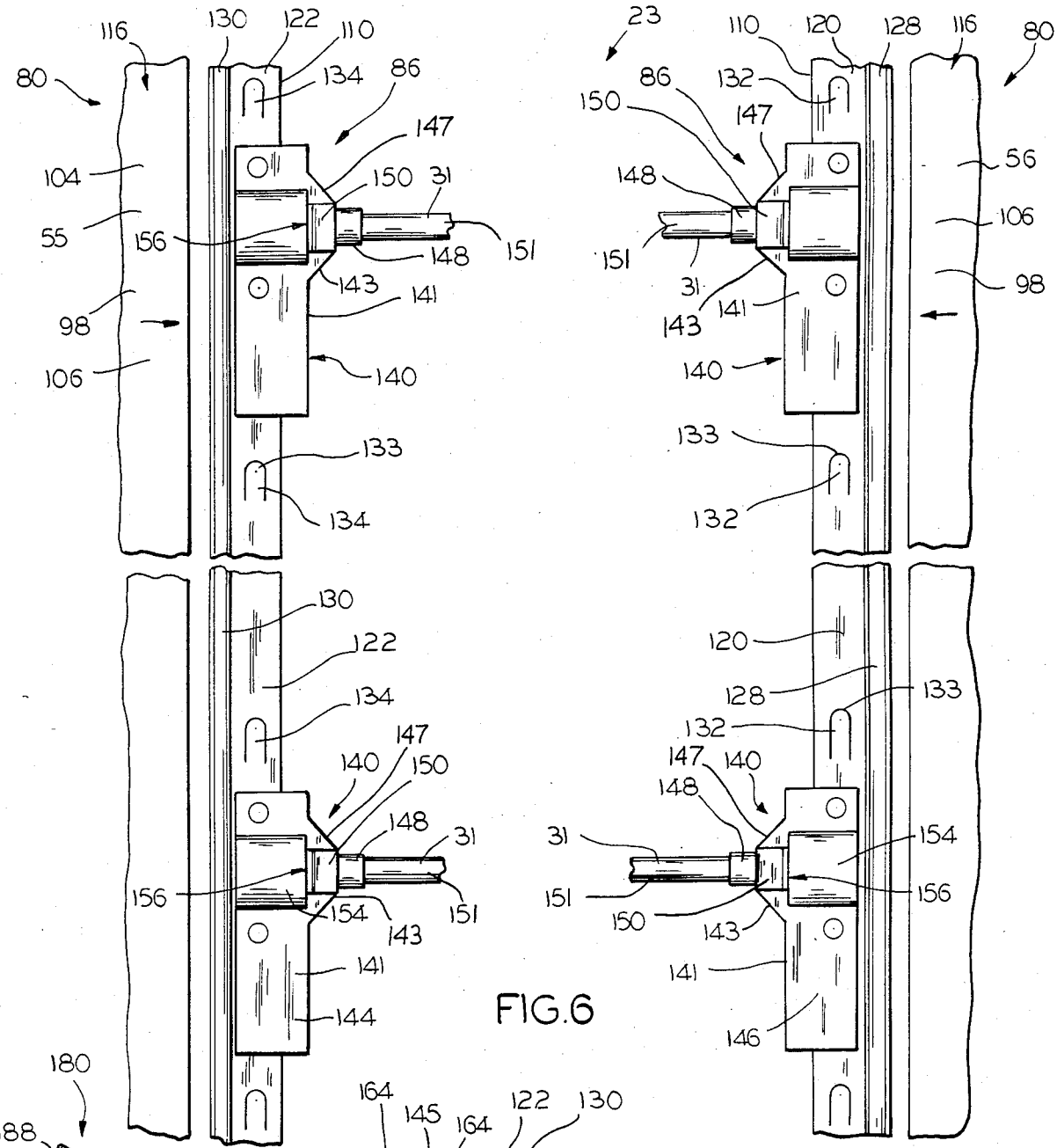
Figure 7:
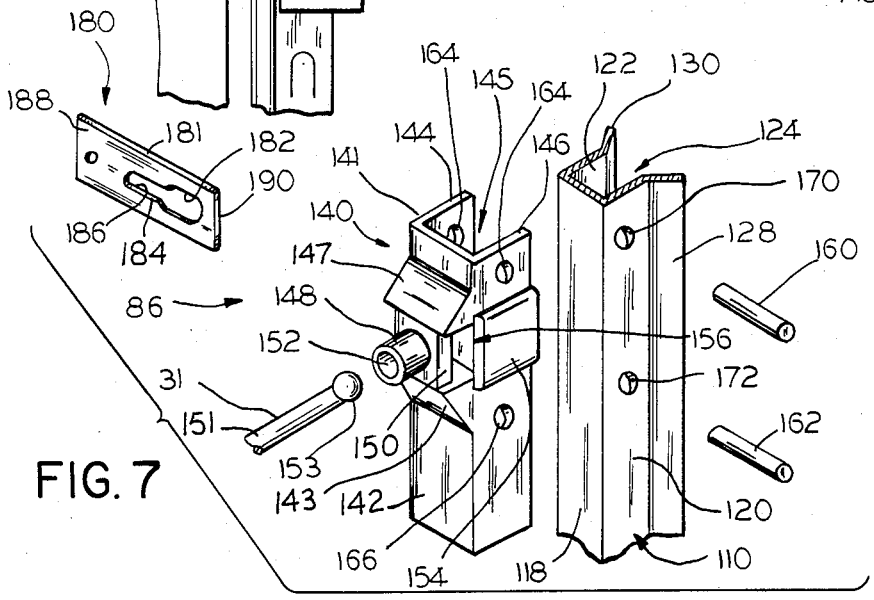

FIG. 6 is a typical vertical sectional view through the folding partition or door at a pair of aligned cover section splines, as viewed substantially along line 6—6 of FIG. 3, with parts broken away and with the cover sections on either side of the partition being shown displaced from the splines that mount same on the partition frame; and FIG. 7 is an exploded perspective view of a portion of one of the folding door or partition cover section splines, and the fitting applied to same for securing same to one of the door or partition lazytongs, and indicating how the fitting is anchored through the spline to the cover section edges supported by the spline.

However, it is to be distinctly understood that the specific arrangements shown in the application drawings are provided primarily to comply with the requirements of the Patent Laws, and that the invention is susceptible of modifications and variations that will be obvious to those skilled in the art, and which are inended to be covered by the appended claims.

GENERAL DESCRIPTION

The improvements of the present invention are illustrated as incorporated in the acoustic type folding door or partition arrangement 10, and specifically, in the folding doors or partitions 20 (see FIG. 2) of the arrangement 10. The acoustic folding door arrangement 10 involved is of the general type disclosed in the above identified Holloway U.S. Pat. No. 3,223,147, the entire disclosure of which is hereby incorporated herein by this reference for additional background purposes.

Figure 2:
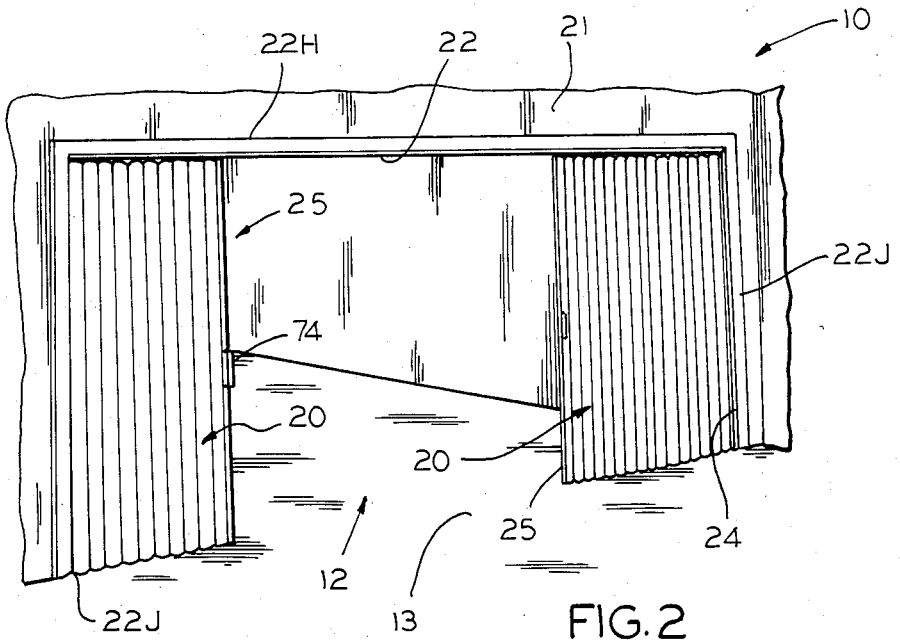
FIG. 2 is a perspective view showing an accordion folding door or partition of the present invention installed as a room divider for dividing a relatively large room into two small rooms.

As disclosed in said Holloway patent, the acoustic folding doors 20 are mounted, as suggested in FIG. 2, in a large room 12 (having a floor 13) so that the doors 20 may be opened when the entire area of the room 12 is to be utilized for one meeting or classroom, and so that by the closure of the folding doors 20, the main room 12 may be subdivided into several smaller rooms. In the arrangement illustrated in FIG. 2, the room 12 is partially divided across its ceiling by a cross wall 21 defining a doorway 22, with the cross wall 24 defining a head 22H and a pair of oppositely disposed jams 22J with any suitable type. The folding doors 20 of the arrangement illustrated in FIG. 2 are two in number and are operatively mounted in the doorway 22 to be shifted from either side thereof to close off the doorway 22 because of the relatively large horizontal dimension of the doorway opening 22. While a single folding door may be employed to close the doorway 22, because of the desirability of observing the aforementioned stacking ratio, typically two of the folding doors 20 are employed to close off a doorway 22 of relatively long horizontal dimension.

While the folding doors 20 that are specifically illustrated in the drawings are assumed to have the improvements of the present invention incorporated therein, folding doors of the general type illustrated are of the general kind disclosed in several prior patents issed to the assignee of the present application, such as the aforementioned Holloway patent and the aforementioned Johnson et al. U.S. Pat. No. 3,056,193.

Figure 1:
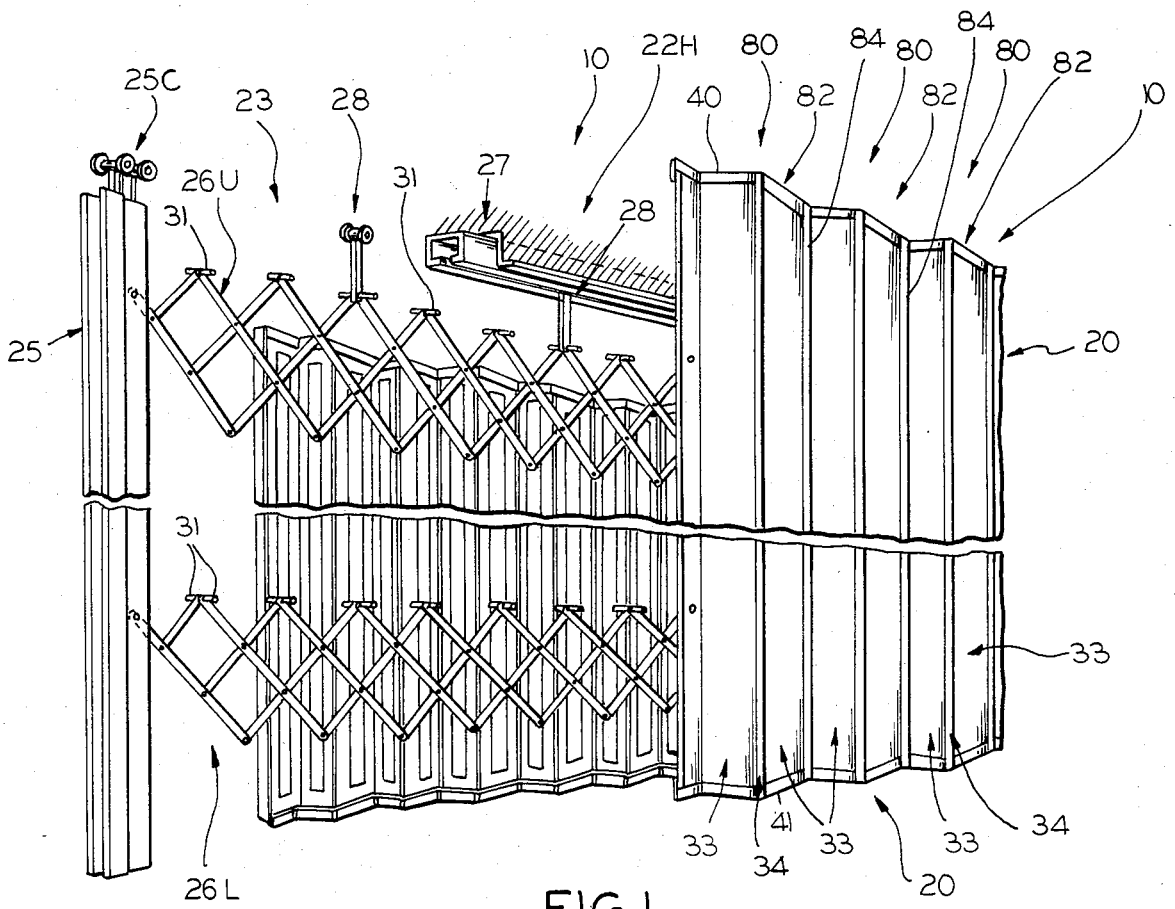
FIG. 1 is a schematic exploded perspective view illustrating the basic elements of the folding door partition arrangement herein disclosed.

Referring to FIG. 1, the folding doors or partitions 20 generally comprise a main frame 23 having a pair of vertically disposed end or edge posts 24 and 25 (see FIG. 3) at opposite ends of same and interconnected by upper and lower lazytongs 26U and 26L of a conventional type. The rear or stationary end post 24 is located adjacent one jamb 22J of the door opening 22, and is secured to the indicated jamb 22J and fixed in air sealed relation in any conventional manner, while the other or lead post 25 is suspended movably from overhead track 27 of any suitable type that extends across the head 22H of the door opening 22 in accordance with conventional practices. The suspension of the lead post 24 is provided in the illustrated embodiment by wheeled carriage 25C that rides in the track 27, and because of the relatively great extended length of the lazytongs 26U and 26L in their extended relations, the upper lazytongs 26U is similarly supported from the track 27 by suitable wheeled hangers 28. As disclosed in said Holloway patent, the details of the end posts 24 and 25, the lazytongs, and the wheeled hangers 25C and 28 may be in accordance with the teachings of said Johnson et al. U.S. Pat. No. 3,056,193.

The folding door end posts 24 and 25, together with the interconnecting lazytongs 26U and 26L, form the extensible and retractable main frame 23 of the folding door 20; on opposite sides of the frame 23, foldable sound barriers are provided which in the illustrated embodiment take the form of covers 30 that are detachably secured to the frame 23. For this purpose, the lazytongs 26U and 26L have a plurality of pivotal joints between the links thereof, in accordance with the usual lazytong structure, and in the illustrated embodiment the uppermost row of such pivotal joints of the respective lazytongs 26U and 26L is provided by a plurality of laterally projecting support pins 31 which provide a part of the connection between the respective covers and the indicated lazytongs 26U and 26L.

The second folding door 20 of the doorway 22 is arranged in a similar manner, as illustrated specifically in FIG. 1 (though its edge post 24 is hidden from view by the jamb 22J at that end of the doorway 22).

Improvements of the present application are concerned with the arrangement of the covers 30 and the manner of their connection to the support pins 31, as is diagrammatically illustrated in FIGS. 3–7 of this application.

In connection with the covers 30, they follow the disclosure of said Holloway patent in comprising a plurality of alternate wide slats 33, with adjacent pairs of wide slats 33 being separated by narrow slats 34, and such slats are pivotally connected by inner and outer cover sheets 55 and 56 as will be hereinafter described in some detail. At opposite ends of each cover 30 attachment slats of a conventional type may be provided that engage opposite sides of the respective door end posts 24 and 25 and may be secured thereto in air tight relation thereto in the manner described in said Johnson et al. patent. The cover ends can be removably clamped to the respective posts 24 and 25 in sealed relation thereto, under such respective slats in any suitable manner. In the form shown, as to post 25, it is shown in the form of aluminum extrusion 35 having facing pieces 37 secured to the sides of same by suitable screws 39, as will be elucidated hereinafter. The connection of the respective covers 30 to posts 24 may be in like manner.

Figures 3A, 4:
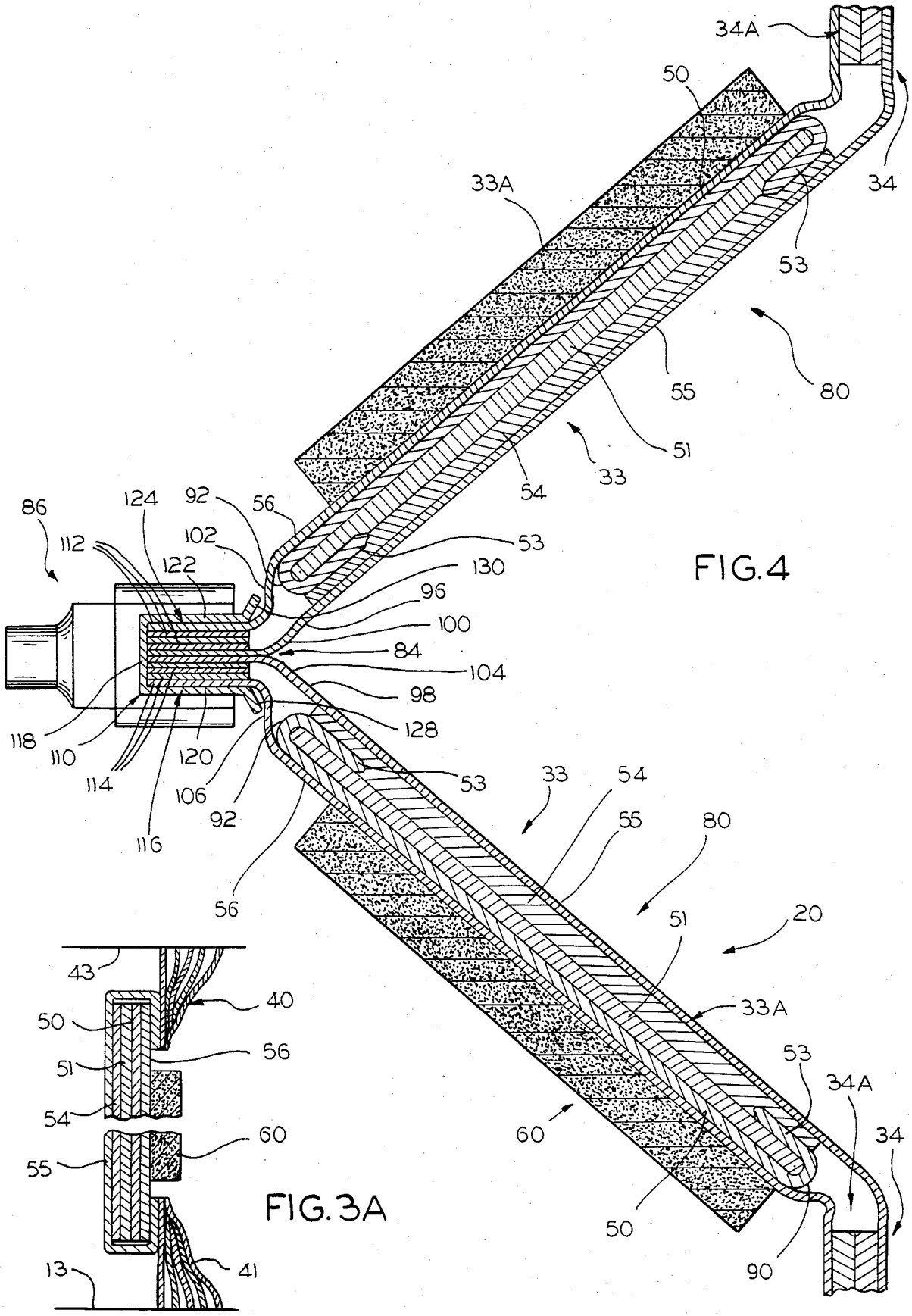
FIG. 3A is a fragmentary vertical sectional view of one of the cover sections, showing the customary sweep strips associated with the upper and lower edges of the cover, and with parts broken away.
FIG. 4 is an enlarged horizontal cross-sectional view showing two connected together cover sections as disposed when the door is in its fully opened position of FIG. 3.

It is also pointed out that along the upper and lower edges of each cover 30, there is a flexible sweep strip 40 provided along the upper edge of the cover and a similar flexible sweep strip 41 provided along the lower edge of the cover, in accordance with the usual practice with regard to acoustic doors and partitions. The sweep strips 40 and 41 ride along the room ceiling, or floor, or other opposed faces of the room 12 that in the mounted arrangement of the doors 20 opposes the respective upper and lower edges of the respective covers 30. As shown in FIGS. 7 and 12 of said Holloway patent, the sweep strips 40 and 41 are identical and are of five-ply construction with the center ply being provided by a felt member that is not shown. The flexible sweep strips 40 and 41 seal the respective covers 30 at their upper and lower edges in accordance with conventional practice with regard to acoustic type doors and partitions, and frictionally ride against the surfaces they engage as the door is moved between its stacked, doorway open relation and its extended, wall forming arrangement, the latter position being approximately that shown at FIG. 3 for the folding door 20. FIG. 3A of this disclosure is provided to illustrate the upper and lower sweep strips 40 and 41 in some detail, with the upper sweep strip 40 shown riding on the usual horizontal surface 43 that is provided within head 22H (by, for instance, wing flanges of the track 27 involved), and the lower sweep strip 41 riding on floor 13 in the specific door arrangement 10 of FIG. 2.

Following conventional practice, the post 25 of the respective doors 20 is provided with suitable means for sealing the doors when both doors are moved to their extended doorway closing positions. For this purpose the respective doors or partitions 20 of doorway 22 are extended to bring their lead posts 25 in substantial juxtaposition. In the event that a single folding door or partition 20 is employed for a particular doorway opening, the opposed element of the sealing couple involved is mounted in opposed and sealed relation with respect to the doorway jamb opposing the door 20 involved.

For purposes of disclosure the sealing action involved may be provided by face member 70 secured to the lead post 25 of one of the two cooperating folding doors or partitions 20, and opposed face member 71 is secured to the lead post 25 of the other folding door 20. The face member 70 is shown to have a pair of spaced ferrous metal strip portions 72 in its leading face and adjacent opposite sides thereof, while the other face member 71 has a pair of elongated sealing elements 73 mounted therein so as to be located to engage the respective ferrous elements 72 of member 70. The sealing elements 73 are of a known type where the bendable plastic strip involved has permanent magnet means embedded therein so when the two members 70 and 71 are located adjacent each other, the magnet members attach themselves to the respective ferrous strip portions 72 to form an effective seal between the members 70 and 71 throughout the entire vertical height of these members, which is equivalent for the height of the respective covers 30. A latch or lock 74 of any suitable type is preferably provided to act between the respective lead posts, so as to releasably hold the two face members 70 and 71 in sealing relation; this latch may be of the type shown in Ensign U.S. Pat. No. 2,861,660, granted Nov. 22, 1958 (the disclosure of which pertaining to said latch or lock 74 is incorporated herein by this reference).

From what has been described so far, it will be seen that the respective accordian folding doors or partitions 20 have covers 30 on opposite sides of same, with the objective also being that the side, top, and bottom edges of both covers 30 are to be effectively sealed against air leakage about all four edges of the respective covers 30, as disclosed in said Holloway patent. This air sealing of the covers 30 about the four edges thereof along the length of the space occupied by the doors 20 in their extended relations, is intended to provide an effective sound barrier particularly with respect to sound of relatively high frequency.

However, in practice it has been found that the lower or middle ranges of sound as encountered in ordinary school rooms or meeting rooms, requires special attention for additional attenuation of such sound, and this is one of the objectives of the folding door cover arrangement disclosed in said Holloway patent.

SPECIFIC DISCLOSURE

FIGS. 3–7 illustrate the covers 30 arranged in accordance with the present invention, and operably carried by the respective door or partition frames 23 in accordance with the present invention.

In accordance with the present invention, the respective covers 30 are each made up of a plurality of replaceable cover sections 80 that are disposed in side by side relationship to form the respective covers 30, and are respectively coextensive with and form the respective pleats or folds 82 of the respective covers 30.

Figure 5:
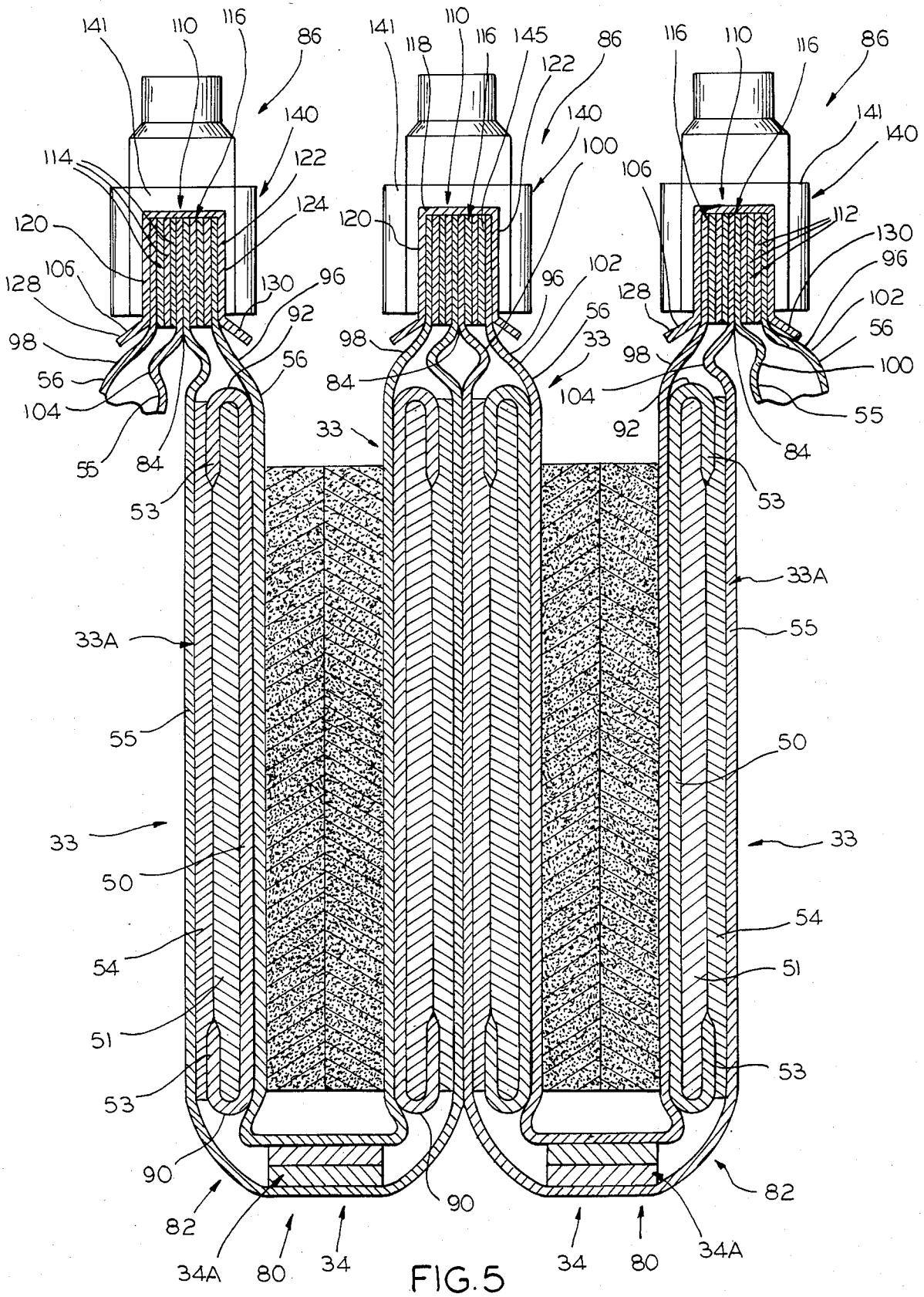
FIG. 5 is a view similar to that of FIG. 4, but showing several different cover sections and the relation of the parts thereof when the folding door or partition is in its stacked relation.

Each cover section 80 is arranged in the manner indicated in FIGS. 4 and 5 to form the wide slats 33 and the narrow slats 34, the specifics of which slats may be similar to the corresponding slats 33 and 34 disclosed in said Holloway patent. Thus, for each cover section 80, a pair of wide slats 33 are provided that are separated by a narrow slat 34. The narrow slats 34 of the covers of said Holloway patent are omitted at the cover joints 84 defined by respective pleats or folds 82 in favor of the spline and connection fitting devices 86 that unite adjacent cover sections 80 and mount the resulting covers on the door or partition frame 23.

The wide slats 33 of each cover section 80 may be the same as the wide slats 33 disclosed in said Holloway patent, and thus may comprise multi-ply body structures 33A that are of a length to extend approximately the height of the cover 30, and that are formed to include a thin plate 50 of mild or rolled steel, which preferably is of 24 gauge thickness (although thicknesses from 22 gauge to 30 gauge have been employed for this purpose). The steel plate 50 is initially somewhat wider prior to processing in accordance with said Holloway than the final width that it is to have as provided in the slats 33; a thin panel 51 of chipboard or the like is adhered to one face of the steel plate 50, and the vertical edges of the steel strip are rolled into return bends or flanges 53 which clamp the chipboard panel 51 at its edges and serve also to impart stiffness to the steel plate 50. A second chipboard panel 54 is then adhered to the steel plate flanges 53 and the chipboard panel 51, so that the panel 54 overlies the steel plate flanges 53, as shown in FIGS. 4 and 5 of the instant application. Alternately, the metal plate 50 may be omitted in favor of a panel of chipboard (not shown), with the resulting three ply chipboard unit being suitably bonded together in a unitary manner, to form the wide slats of each cover section 80.

The narrow slats 34 may be formed as disclosed in said Johnson et al. patent, and thus comprise a body structure 34A of multiple nature made up of cardboard or chipboard strips or the like, that are of lengths to coextensively extend the height of cover 30, and that are suitably bonded together.

In fabricating the respective cover sections 80, the narrow slat bodies 34A thereof are interposed between and spaced from the pair of wide slats 33A for a particular cover section 80, to form the respective slats 33 and 34 thereof, and such wide slat bodies 33A and the narrow slat bodies 34A separating same are then connected together in pivoted relationship by the application thereto of a decorative outer cover sheet 55, formed from vinyl plastic or the like, and an inner cover sheet 56 that may be made or formed from a suitable grade of kraft paper. For this purpose the respective sheets 55 and 56 of each cover section 80 are suitably bonded to the surfaces of the respective wide slat and narrow slat bodies 33A and 34A they engage, as by employing a suitable adhesive or cement for this purpose, to form the respective wide slats 33 and the narrow slat 34 of each cover section 80.

Following the disclosure of said Holloway patent, on the inner side of the respective cover sections 80 in coextensive relation to the wide slats 33 thereof, a panel 60, comprising a pad of resilient fibrous insulating material, such as matted glass fibers, is glued to the respective cover sections involved, in substantially coextensive relation to the lengths of the respective wide slats 33 of same, as indicated in FIGS. 4 and 5.

As indicated in FIGS. 4 and 5, the panel 60 that is coextensive with each wide slat 33 of the respective cover sections 80 is located to be closer to the edges 90 of the rigid bodies 33A (which form the core of the wide slats 33), which edges 90 of the respective wide slat cores 33A are closest to the body 34A that forms the core of the relatively narrow slat 34 of each cover section 80. Thus it will be observed that the respective panels 60 are spaced further from the edges 92 of the body 73A than at the side edges 90 of same (see FIGS. 4 and 5) to accommodate ease of movement of the respective covers 30 as the respective doors or partitions 20 are moved between the folded and unfolded relations. The fiber panels 60 are approximately one-half inch in thickness when compressed, and, as suggested in said Holloway patent, may have a density of approximately one-half pound per cubic foot, although other densities may be employed, as desired.

While the stiffness of the wide slats 33 in the illustrated embodiment is obtained by reverse bends 53 of steel plate 50, this arrangement may be replaced by using the embodiment of FIGS. 6 and 8–10 of said Holloway patent, in which the stiffening of the wide slat 53 is provided by bending the metal slat and the chipboard slat that is secured to same at a slight angle along its longitudinal center line (as disclosed in said patent), or as suggested hereinbefore, using a three ply body 33A made up of bonded together chipboard panels.

The resulting cover sections 80 have, in accordance with the present invention, extending side edges 96 and 98 that are defined by corresponding edges of the respective cover sheets 55 and 56, that, in accordance with the present invention, are utilized to replaceably or removably mount the respective cover sections 80 together in side by side relation as well as provide for removable mounting of the resulting cover 30 on the door frame 23.

More specifically, at the cover section side edges 96 the outer and inner sheets 55 and 56 extend beyond the wide slat bodies 33A, and specifically their side edges 92 that are located at the section side edges 96, to define marginal side edge portions 100 and 102 (see FIGS. 4 and 5, while at the side edges 98 of the cover sections 80, the sheets 55 and 56 extend beyond the respective edges 92 of the wide slat bodies 33A to define marginal edge portions 104 and 106. The marginal edge portions 100, 102, 104 and 106, are respectively integral with the respective sheets 55 and 56, and accordingly extend the height of the respective covers 30.

In accordance with the invention, at each joint 84 defined by the side by side cover sections 80, the marginal side edges 100 and 102, 104 and 106, that converge at that joint 84 are inserted within and secured to the respective elongate splines 110 (see FIGS. 4–6) that are of generally channel shaped transverse cross-sectional configuration for this purpose and extend the height of the respective covers 30, and in particular cover sections 80.

In the specific arrangement illustrated, as seen in FIGS. 4 and 5, at the side edge 96 of the respective cover sections 80, the cover section marginal side edge portions 100 and 102 have applied between same several lengths (three in the illustrated embodiment) of chipboard or cardboard strips 112 having a length compared to the height of cover sections 80, while the marginal edge portions 104 and 106 of the respective sheets 55 and 56 at the cover section edges 98 have applied between same strips 114 that are similar to the strips 112, with the resulting composite body 116 (made up of edge portions 100, 102, 104 and 106 and strips 112 and 114, which may be stapled together to form body 116) being inserted in the respective splines 110.

The splines 110 are preferably formed from metal (such as mild steel) and define an integral manner base wall 118 and integral side walls 120 and 122 projecting normally thereof to define the elongate socket 124 in which the body 116 is received. The spline side walls 20 and 22 preferably are formed at their outer margins to define the respective positioning flanges 128 and 130 that are preferably disposed at an angle of approximately 45 degrees with respect to the respective side walls 120 and 122, to serve as stops for limiting the pivoting movement of the respective cover sections 80 toward the unfolded relations of the pleats or folds 82 defined by the respective cover sections 80 (compare FIGS. 4 and 5).

The splines 110 are secured to the composite bodies 116 by depressing inwardly of the respective spline side walls 120 and 122 the respective deflectable fingers 132 and 134 (see FIG. 6) thereof to bind and fix the composite body 116 along the respective cover joints 84 within the respective splines 110. The respective fingers 132 and 134 are formed in uniformly spaced apart relation along the length of the respective spline side flanges 120 and 122, respectively, and may be deflected in any suitable manner inwardly of the respective splines 110. The free ends 133 of the respective fingers 132 and 134 should be directed upwardly in the positioning of the respective splines 110, and the mounted relation of the covers 30 with respect to the frame 23, so that gravity assists in holding the respective cover sections 80 against displacement vertically in the respective splines 110.

As indicated in FIGS. 4, 5 and 6, the respective splines 110 at the level of the respective lazytong pins 31 are provided with fittings 140 that are preferably formed from a suitable plastic material, such as nylon, and define bodies 141 that are of channel shaped configuration to form base wall 142 and side walls 144 and 146 that are spaced apart to define a socket 145 that closely receives the respective splines 110 in frictional type slip fit relation thereto for ready adjustment along the respective splines 110. The fittings 140 each include a sleeve portion 148 that is integrally connected with quadrilateral base portion 150 which is in turn integrally connected with the fitting base wall 142 by opposed integral sloped flanges 143 and 147 in such a manner that it is displaced exteriorly of the spline out of the plane of the spline base wall 142 but parallels same. The sleeve 148 is formed with a bore 152 that extends through base portion 150 and is proportioned to receive the balled end 153 of lazytong pin 31 in force fit relation thereto, and to receive the shank 151 of the lazytong pin 31 in slip fit relation thereto. Bore 152 is open to the fitting socket 145. The fitting 140 in the specific form illustrated has its side walls 144 and 146 indented outwardly of the fitting where indicated at 154, at the level of the sleeve 148 of the respective fittings 140, to there enlarge the fitting socket 145; in addition, the fitting 140 is open adjacent either side portion 154, as at 156 on either side of the sleeve 148, so that the fitting base portion 150 is set back away from its socket 145, whereby the balled end 151 of the pin 31 to which the fitting 140 is applied is lodged between the fitting base portion 150 and its socket 145, when the fitting has been force fitted on a pin 31, as indicated. The result is that the pins 31 can be journalled in the respective fitting sleeve bores 152, while the fittings 140 receive the respective splines 110 well within the respective fitting sockets 145 without the spline 110 interferring with the respective pins 31.

As is further indicated in FIGS. 6 and 7, the fittings 140 are disposed on the respective splines 110 at the elevational levels of the respective pins 31 of the upper and lower lazytongs. At each such level, the fittings 140 after being received over the respective splines in the manner indicated in FIGS. 4–6, are fixed to the respective splines 110 by applying suitable removable roll pins 160 and 162 through the aligned apertures 164 and 166 of the fittings 140, and the corresponding apertures 170 and 172 that are formed at the identical locations along the respective splines 110 to mount the fittings 140 at their designed operative levels relative to the lazytong pins 31. For this purpose, the apertures 164 and 166, of the fittings 140, and the apertures 170 and 172 of the respective splines, may be preformed in these components in accordance with the respective dimensions involved to properly locate the fittings 140 with respect to the pins 31 of the lazytongs on either side of the door 20. The pins 160 and 162 are passed through the respective bodies 116 and while they may be in the nature of removable roll pins, equivalent removable fasteners may be in the form of rivets, screw and nut assemblies, or the like; it is contemplated that the individual cover sections 80 be removably mounted in forming a part of the respective covers 30, and accordingly the connections of same at the tongues 132 and 134 and at the fittings 140 should be releasably arranged to permit the substitution of a new cover section 80 for one that has, for instance, been damaged in application or service.

Assuming that the respective cover sections 80 are applied to the respective splines 110 of a cover 30, so that such sections 80 are in side by side relation and define joints 84 therebetween, the respective fittings 140 are applied to the respective splines 110 in the manner already indicated. With the fittings 140 anchored to the splines 110 of a particular cover 30, such cover may be applied to the respective pins 31 of the lazytongs 26U and 26L with the force fit indicated. When both of the covers 30 have been applied to the lazytongs of a particular door or partition 20, the door is arranged in accordance with the showings of FIGS. 1 and 3 for being shifted to the doorway open position or the doorway closing position, as has been described.

Where the doors 20 are sufficiently large that the movement of the doors 20 between open and closed positions tends to create sufficient forces on the bodies 116, sidewise and outwardly of frame 23 that would pull the fittings 140 off of pins 31, a conventional keeper 180 may be employed in connection with each fitting 140. The individual keepers 180 (see FIG. 7) each comprise a bendable strip 181 of metal proportioned for slide fitting through the openings 156 of the fitting 140 to dispose the large portion 182 of the keeper locking aperture 184 in alignment with the pin ball head 153, which is then thrust through aperture 184, after which the keeper 180 is shifted longitudinally thereof to dispose the pin shank 151 within the aperture narrow portion 186; the ends 188 and 190 of keeper 180 may then be bent approximately ninety degrees, and thus into substantial parallelism, to lock the keeper in place.

At the lead post 25, the side edges 96 of the leading end cover sections 80 may be suitably fitted and/or bonded into the respective channels or slots 192 and 194 of the respective facing pieces 37, to complete the sealing of the covers 30 at post 25. A strip 196 of fabric or the like that is the same color as the outer cover sheets 55, may be suitably bonded to the respective facing pieces 37 in masking relation to screws 39. The connection of the respective side edges 98 of the trailing end cover sections 80 may be fixed to post 24 in like manner.

The arrangement of the covers 30 and the mounting of same on the door or partition framework 23, in accordance with the present invention, provides a number of important advantages.

For instance, as indicated, each fold or pleat of the respective covers 30 comprises a cover section 80. Should any individual cover section 80 be damaged in application or use, it can be replaced by a substitute cover section 80 mounted in its place, which avoids discarding the entire cover 30 for a particular door 20. For this purpose any cover section 80 may be removed from the doors 20 for replacement removing the cover 30 involved from frame 23, removing the damaged cover section 80 from the splines 110 and fittings 140 supporting same, applying the replacement cover section 80 thereto, and remounting the cover in question on frame 23. The spline tongues 130 and 132 may be bent as needed for this purpose using suitable hand tools.

Folding door or partition covers 30 arranged in accordance with the present invention permit the folding door or partition to stack in a tighter manner with less stacking dimension, and with the pads 60 free of compression. Further, the cover sections 80 involved are arranged to be beefed up with more mass with the result that the overall covers 30 will be heavier and will provide STC ratings that are an improvement over folding doors and partitions arranged in accordance with said Holloway patent.

It has further been found that the spline and fitting attachment arrangement for applying the individual cover sections to the door or partition lazytongs provides a true parallel relationship of the pleats as they are moved between retracted and extended relations. In addition, the individual cover sections are free of visible fasteners on their exterior sides, only the joints 84 being visible along the lengths of the respective covers 30. The respective covers 30 are much sturdier than prior acoustic type door or partition constructions at the connections of the covers to the lazytongs because of the presence of the splines that rigidify the individual cover sections of each connection for the height of the cover.

An important feature of the arrangement of the present invention is that there is no "spring back" of the door or partition as it is moved away from its contracted relation towards its extended relation. This is believed to be one result of subdividing the covers 30 into the individual cover sections 80, as it eliminates the effect of elastic memory of the outer cover sheets 55 involved, where such cover sheet 55 is coterminuous with the cover 30 it forms a part of. In practice it has been found that acoustic type folding doors or partitions made in accordance with the present invention have a very smooth movement between extended and contracted relations with no "spring back" in either direction, in spite of the tendency of lazytongs of significant lengths to have "spring back" tendencies.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In an accordion type folding door having a pair of end posts that define opposite vertical end edges of the door, upper and lower extensible and collapsible lazytongs connecting said posts, foldable cover means disposed along opposite sides of said lazytongs and connected at opposite ends to the respective posts, and flexible sealing skirts attached to and projecting from the upper and lower edges of the cover means, the improvement wherein each of said cover means comprises:

a plurality of vertical cover sections separately connected to said lazytongs in side by side relation, each of said cover sections comprising:

a pair of relatively wide slats of substantially equal widths disposed on either side of a relatively narrow slat, said slats of each cover section being pivoted together by inner and outer flexible sheets respectively adhered to opposite faces of the respective slats and with said narrow slats interposed between said relatively wide slats whereby said relatively wide slats of each said cover section define a first vertical side edge that is disposed adjacent said narrow slat thereof and a second vertical side edge that is opposed to said first said edge thereof, said inner and outer sheets of the respective cover sections terminating in vertical edge portions extending beyond said second vertical side edges of both said relatively wide slats of each said cover section and forming first and second sheet end portions at like side edges of each said cover section, means for clamping together the second and first sheet end portions of adjacent of said cover sections along the height of said cover means, respectively, means for anchoring each of said clamping means to the lazytongs to connect same to the lazytongs and including means for journalling the respective lazytongs on the respective clamping means, and means for anchoring the said cover section first and second sheet end portions at said opposite ends of said cover means to the respective posts, said cover sections each including a pair of pads of low density resiliently compressible fibrous sound insulating material, with each such pad of each said cover section being mounted internally thereof in full surfaced flush contacting relation against the inner sheet of said section thereof at a location overlying and substantially masking one of the wide slats thereof, said pads and said wide slats of each cover section being proportioned such that in the folded stacked door open relation of said folding door, said pads of each section engage each other free of any substantial compression.

2. The improvement set forth in claim 1 wherein:

said clamping means each comprises:

a spline extending substantially the height of said cover means and formed to clampingly receive the respective second and first sheet end portions of an adjacent set of said cover sections.

3. The improvement set forth in claim 2 wherein:

said splines each include upwardly directed tongues on either side of same that are clamped against the sheet end portions received therein.

4. The improvement set forth in claim 2 wherein:

said means for anchoring each of said splines to said lazytongs comprises:

a first fitting pinned to the respective splines at the level of the upper lazytongs and including said means for journalling the upper lazytongs on the respective splines, and a second fitting pinned to the respective splines at the level of the lower lazytongs and including said means for journalling the lower lazytongs on the respective splines.

5. The improvement set forth in claim 1 wherein:

the respective cover sections fully mask the connections of same to the lazytongs.

6. The improvement set forth in claim 1 wherein:

the inner and outer sheets of the respective cover sections are removably joined to each other adjacent said second side edges of the relatively wide slats thereof.

7. In an accordion type folding door having a pair of end posts that define opposite vertical end edges of the door, upper and lower extensible and collapsible lazytongs connecting said posts, foldable cover means disposed along opposite sides of said lazytongs and connected at opposite ends to the respective posts, and flexible sealing skirts attached to and projecting from the upper and lower edges of the cover means, the improvement wherein each said cover means comprises:

a plurality of vertical cover sections separately connected to said lazytongs in side by side relation, each of said cover sections comprising:

a pair of relatively wide slats of substantially equal widths disposed on either side of a relatively narrow slat, said slats of each cover section being pivoted together by inner and outer flexible sheets respectively adhered to opposite faces of the respective slats, and with said narrow slat thereof interposed between said relatively wide slats whereby said relatively wide slats of each said cover section define a first vertical side edge that is disposed adjacent said narrow slat thereof and a second vertical side edge that is opposed to said first side edge thereof, said inner and outer sheets of the respective cover sections terminating in vertical edge portions extending beyond said second vertical side edges of both said relatively wide slats of each said cover section and forming first and second end portions at like side edges of each said cover section, means for clamping together the second and first sheet end portions of adjacent of said cover sections along the height of said cover means, means for anchoring each of said clamping means to the lazytongs to connect same to the lazytongs and including means for journalling the respective lazytongs on the respective clamping means, and means for anchoring the said cover section first and second sheet end portions at said opposite ends of said cover means to the respective posts, said wide slats of said cover sections between said sheets thereof comprising a multi-ply generally planar structure, said wide slats of said cover sections each having applied thereto along the length of such wide slats a uniform layer of resilient fibrous sound insulating material.

8. The improvement set forth in claim 7 wherein:

said clamping means each comprises:

a spline extending substantially the height of said cover means and formed to clampingly receive the respective second and first sheet end portions of an adjacent set of said cover sections.

9. The improvement set forth in claim 8 wherein:

said splines each include upwardly directed tongues on either side of same that are clamped against the sheet end portions received therein.

10. The improvement set forth in claim 8 wherein:

said means for anchoring each of said splines to said lazytongs comprises:

a first fitting pinned to the respective splines at the level of the upper lazytongs and including said means for journalling the upper lazytongs on the respective splines, and a second fitting pinned to the respective splines at the level of the lower lazytongs and including said means for journalling the lower lazytongs on the respective splines.

11. In an accordion type folding door having a pair of end posts that define opposite vertical end edges of the door, extensible and collapsible lazytongs connecting said posts, foldable cover means disposed along opposite sides of said lazytongs and connected at opposite ends to the respective posts, and flexible sealing skirts attached to and projecting from the upper and lower edges of the cover means, the improvement wherein each said cover means comprises:

a plurality of vertical cover sections separately connected to said lazytongs in side by side relation, each of said cover sections comprising:

a pair of relatively wide slats of substantially equal widths disposed on either side of a relatively narrow slat, said slats of each cover section being pivoted together by inner and outer flexible sheets respectively adhered to opposite faces of the respective slats, and with said narrow slat thereof interposed between said relatively wide slats whereby said relatively wide slats of each said cover section define a first vertical side edge that is disposed adjacent said narrow slat thereof and a second vertical side edge that is opposed to said first side edge thereof, said inner and outer sheets of the respective cover sections terminating in vertical edge portions extending beyond said second vertical side edges of both said relatively wide slats of each said cover section and forming first and second end portions at like side edges of each said cover section, means for clamping together the second and first sheet end portions of adjacent of said cover sections along the height of said cover means, means for anchoring each of said clamping means to the lazytongs to connect same to the lazytongs and including means for journalling the lazytongs on the respective clamping means, and means for anchoring the said cover section first and second sheet end portions at said opposite ends of said cover means to the respective posts, with the inner and outer sheets of the respective cover sections being removably joined to each other adjacent said second edges of the relatively wide slats thereof.

12. The improvement set forth in claim 11 wherein:

said clamping means each comprises:

a spline extending substantially the height of said cover means and formed to clampingly receive the respective second and first sheet end portions of said adjacent set of said cover sections.

13. The improvement set forth in claim 12 wherein:

the respective cover sections fully mask the connections of same to the lazytongs.

14. The improvement set forth in claim 12 wherein:

the respective cover sections mask said splines for the height of the respective cover means.

* * * * *